US009691570B1

(12) United States Patent
Dinh et al.

(10) Patent No.: US 9,691,570 B1
(45) Date of Patent: Jun. 27, 2017

(54) MODULAR TACTILE SWITCH

(71) Applicant: Apple Inc., Cupertino, CA (US)

(72) Inventors: Richard Hung Minh Dinh, Cupertino, CA (US); Jonathan C. Denby, Cupertino, CA (US); Liane J. Fang, Cupertino, CA (US)

(73) Assignee: APPLE INC., Cupertino, CA (US)

( * ) Notice: Subject to any disclaimer, the term of this patent is extended or adjusted under 35 U.S.C. 154(b) by 241 days.

(21) Appl. No.: 14/525,979

(22) Filed: Oct. 28, 2014

Related U.S. Application Data

(60) Provisional application No. 61/896,176, filed on Oct. 28, 2013.

(51) Int. Cl.

| | |
|---|---|
| ***H01H 13/10*** | (2006.01) |
| ***H01H 13/06*** | (2006.01) |
| ***H01H 13/14*** | (2006.01) |
| ***H01H 11/00*** | (2006.01) |

(52) U.S. Cl.
CPC ..... *H01H 13/10* (2013.01); *H01H 11/00* (2013.01); *H01H 13/06* (2013.01); *H01H 13/14* (2013.01); *H01H 2215/00* (2013.01); *H01H 2221/056* (2013.01); *H01H 2223/002* (2013.01); *H01H 2229/022* (2013.01); *H01H 2229/048* (2013.01)

(58) Field of Classification Search
CPC ..... H01H 13/10; H01H 11/00; H01H 13/06; H01H 13/14; H01H 9/04; H01H 13/36; H01H 13/48; H01H 2233/074; H01H 2233/058; H01H 13/365; H01H 9/08
USPC ..... 200/513, 302.2, 302.1, 341, 516, 517, 200/50.02, 295, 556
See application file for complete search history.

(56) References Cited

U.S. PATENT DOCUMENTS

| | | | | |
|---|---|---|---|---|
| 3,170,049 | A | 2/1965 | Clavel | |
| 4,300,026 | A | 11/1981 | Bull | |
| 5,559,311 | A | 9/1996 | Gorbatoff | |
| 5,813,520 | A * | 9/1998 | Reier | H01H 21/22 200/330 |
| 5,969,309 | A | 10/1999 | Nishimura et al. | |
| 7,164,091 | B2 * | 1/2007 | Lu | H01H 1/5805 200/292 |
| 7,532,096 | B2 | 5/2009 | Zindler | |
| 8,604,372 | B2 * | 12/2013 | Yang | H01H 13/807 200/341 |
| 8,853,574 | B2 * | 10/2014 | Christophy | H01H 15/02 200/302.1 |
| 8,981,245 | B2 * | 3/2015 | Dinh | H01H 1/20 200/243 |

* cited by examiner

*Primary Examiner* — Edwin A. Leon
(74) *Attorney, Agent, or Firm* — Brownstein Hyatt Farber Schreck, LLP

(57) ABSTRACT

Modular button components are described that comprise a tactile switch coupled to a center portion of the modular button component and at least one electrical contact. A bracket extends beyond a length of the center portion of the modular component. In various embodiments, the tactile switch, the bracket and the at least one electrical contact are insert molded into a single assembly to form the modular button component that is detachably coupled to a printed circuit board.

15 Claims, 4 Drawing Sheets

MODULAR TACTILE SWITCH

CROSS-REFERENCE TO RELATED APPLICATION

This application is a nonprovisional patent application of and claims the benefit to U.S. Provisional Patent Application No. 61/896,176, filed Oct. 28, 2013 and titled "Modular Tactile Switch," the disclosure of which is hereby incorporated herein by reference in its entirety.

TECHNICAL FIELD

The present disclosure is directed to a tactile switch for a mobile computing device. Specifically, the present disclosure is directed to a tactile switch that is removably coupled to a flexible printed circuit board of a mobile computing device.

BACKGROUND

In typical mobile computing devices, tactile switches are integrated into a mobile computing device by reflow soldering or by assembling the tactile switch to flexible printed circuit boards or rigid printed circuit boards. However, connection points between the flexible printed circuit boards and the tactile switch can be exposed to various elements. Specifically, because a button is typically an opening in the housing of an electronic device, chemicals, moisture and other materials can enter the housing and damage the switch underneath the housing. In addition to the above, the structure of the housing and/or the assembly of components may require that the printed circuit boards need to be shaped in such a way that makes it difficult to assemble.

It is with respect to these and other general considerations that embodiments have been made. Also, although relatively specific problems have been discussed, it should be understood that the embodiments should not be limited to solving the specific problems identified in the background.

SUMMARY

This summary is provided to introduce a selection of concepts in a simplified form that are further described below in the Detail Description section. This summary is not intended to identify key features or essential features of the claimed subject matter, nor is it intended to be used as an aid in determining the scope of the claimed subject matter.

One or more embodiments of the present disclosure provide a modular button component. The modular button component may include: a switch coupled to a center portion of the modular button component; a bracket extending beyond a length of the center portion of the modular component; and at least one electrical contact positioned on the center portion, wherein the switch, the bracket and the at least one electrical contact are insert molded into a single assembly to form the modular button component that is removably coupled to a printed circuit board. Both the contact and the switch may extend in the same direction from the center portion of the modular button.

In another embodiment, a method for manufacturing a modular button component is disclosed. In this method, a bracket, a tactile switch and at least one contact are received. In embodiments, the at least one contact is associated with at least one internal trace. Once each of the components is received, the tactile switch, the contact and the associated internal trace are insert molded together with the bracket such that the contact and switch each extend in the same direction from the molded component. As a result of this method, a modular button component is formed.

Yet another embodiment may take the form of an electronic device, including: a structure defining an aperture; a first electrical contact formed on a first side of the structure; a button comprising: a body; a wall on a first side of the body; a switch encompassed by the wall on the first side of the body; and a second electrical contact on the first side of the body; wherein the wall extends through the aperture; and the first and second electrical contacts physically touch one another.

DETAILED DESCRIPTION

Various embodiments are described more fully below with reference to the accompanying drawings, which form a part hereof, and which show specific exemplary embodiments. However, embodiments may be implemented in many different forms and should not be construed as limited to the embodiments set forth herein; rather, these embodiments are provided so that this disclosure will be thorough and complete, and will fully convey the scope of the embodiments to those skilled in the art. The following detailed description is, therefore, not to be taken in a limiting sense.

Generally described herein is a modular button, as well as method of manufacture and assembly for the button. The modular button is coupled to a structure, such as a housing, and may form a waterproof seal with the structure. Accordingly, moisture and/or liquid generally does not pass through the structure around the button.

Electrical contacts may be provided on a surface of the button assembly in order to electrically connect a switch or other input mechanism to an electrical component. In some embodiments, the electrical contacts are positioned on the same side of the assembly that faces the structure. Further, this side may also include the switch or other input mechanism.

The modular button may be configured and/or constructed as a single piece that may be removably affixed to a structure. Fasteners, such as screws, bolts, detents and the like may affix the modular button to the structure such that it may be removed and replaced with relative ease as compared to a button assembly that is soldered or welded into place.

Figure 1:
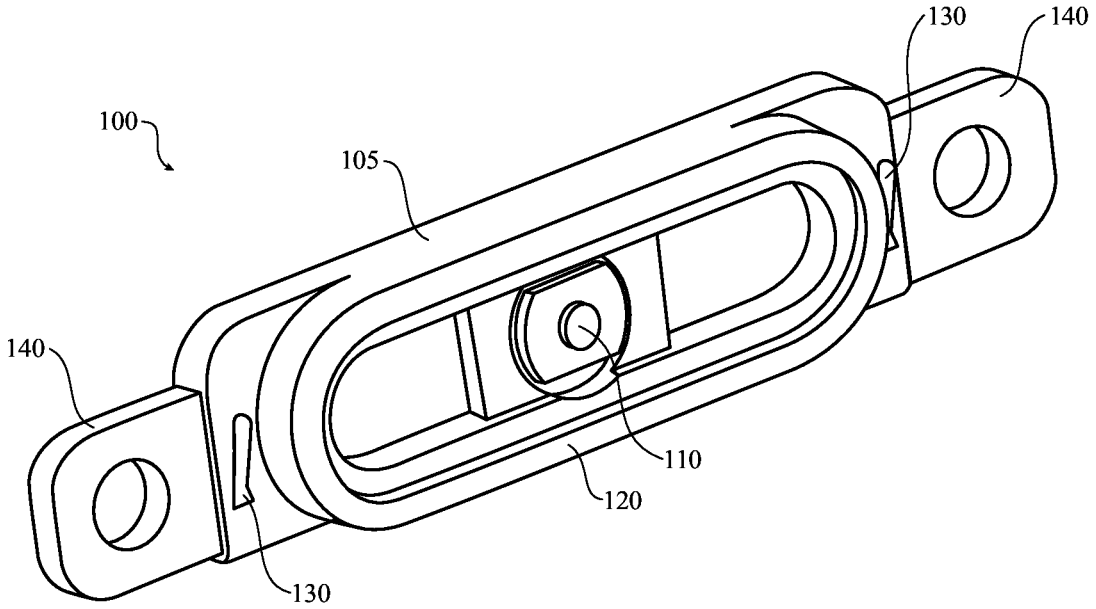
FIG. 1 is an isometric view of a sample modular button component.

With the foregoing in mind, FIG. 1 illustrates an isometric view of a modular button component 100 according to one or more embodiments of the present disclosure. In certain embodiments, and as will be described below, the modular button component is a single piece that may be removably coupled to any of a flexible printed circuit board, a rigid printed circuit board and/or a housing of an electronic computing device. As shown in FIG. 1, the modular button component 100 includes a center portion 105 in which a tactile switch 110 is located. The center portion 105 may be made of plastic, nylon, metal, ceramic, various polymers or other such materials. In certain embodiments, the tactile switch 110 may include or be associated with a dome switch (not shown) or other such mechanism located underneath or above the tactile switch 110 that causes an electrical connection to be made by various contacts, such as, for example, electrical contacts 130. For example, when the tactile switch 110 is depressed, an electrical signal may be generated at one or both of the contacts 130 or elsewhere, as appropriate. As another example, depressing the switch 110 may cause electricity to flow from one contact 130 to another. It should be appreciated that the foregoing may occur when the switch is raised instead of depressed, in some embodiments.

As shown in FIG. 1, the center portion 105 includes a raised outer wall 120 or other raised portion that surrounds the tactile switch 110 and defines an interior recess in which the tactile switch sits or may be contained. In certain embodiments, the raised outer wall 120 may have various configurations and shapes. For example, the raised outer wall 120 may have a uniform shape and height around the entire circumference of the wall such as shown in FIG. 1. In another embodiment, a first portion of the raised outer wall 120 may have a first height while a second portion of the raised outer wall 120 may have a second, different height. Likewise, a first portion of the raised outer wall 120 may have a first shape and a second portion of the raised outer wall 120 may have a second, different shape.

Such configurations may be useful based on, for example, a shape of a button or face that will be mated with tactile switch 110, a shape of a housing or circuit board to which the modular button component 100 will be coupled, and the like. In embodiments, the raised outer wall 120 is configured to receive an adhesive or other such material that causes the raised outer wall 120 to form a waterproof or watertight seal between button assembly 100 and a printed circuit board and/or a housing of a computing device.

In embodiments, the modular button component 100 also includes one or more electrical contacts 130. Although two electrical contacts are shown in FIG. 1, it is contemplated that any number of electrical contacts may 130 be coupled to the modular button component 100. However, unlike traditional electrical contacts that are terminated with or joined to other contacts by solder, one or more embodiments provide that the electrical contacts 130 of the present disclosure take the form of electrically-conductive spring fingers. The spring fingers are designed to make contact with one or more corresponding pads on a flexible or rigid printed circuit board to which the modular button component 100 is coupled or electrically connected, in the event the button is coupled to a housing, flex, circuit board or the like.

As the button assembly 100 is mated to or secured to a housing or other structure, the spring fingers may come in contact with electrical pads on such structures. If the button assembly 100 is pushed against the structure during securing of the two, the spring fingers may bend while maintaining electrical contact. In this fashion, the spring fingers may be loaded with a force but maintain an electrical contact with pads or another suitable electrical conductor/termination across a variety of tolerances between the button assembly 100 and a structure in which it is inserted and to which it is affixed. The spring fingers may be omitted in certain embodiments and replaced by any other suitable electrical connection, such as contact pads, one or more flexes, and so on.

As also shown in FIG. 1, the electrical contacts 130 are located on a proximal end and on a distal end of the center portion 105 (e.g., outside of the raised wall 120 that forms the watertight seal) of the modular button component 100. Although a specific placement of the electrical contacts 130 is shown, it is contemplated that the electrical contacts 130 may be placed in a variety of areas including within the raised outer wall 120. Likewise, it is contemplated that the electrical contacts 130 may be placed in close proximity with each other (e.g., two or more electrical contacts may be located on a distal end of the center portion 105 of the modular button component 100). Generally, although not necessarily, the electrical contacts 130 and the switch 110 may be positioned on the same face (e.g., side) of the modular button switch, and may be positioned on the same face of the center portion of the modular component. Thus, for example, the switch and contact(s) may extend from the center portion (or other portion of the modular component) in a same direction.

It is also contemplated that one or more protection mechanisms may surround, or at least partially surround, the electrical contacts 130. For example, it is contemplated that one or more raised walls (not shown) may surround the electrical contacts 130. These raised walls may prevent the electrical contacts from being bent to one side or another during assembly of the mobile computing device. In such embodiments, the printed circuit board to which the electrical contacts mate with may include a connection mechanism that interconnects with the raised wall portion to ensure a tighter and more secure seal with the electrical contacts 130. In addition to the above, one or more internal traces (not shown) connect one or more electrical contacts 130.

Although not shown, a face (such as a button structure) may be at least partially received in the hollow defined by the outer wall 120. The face may be depressible or otherwise movable and such motion may actuate the switch 110, or the switch may be actuated when the face is in a particular position. The face may be a rocker face, a depressible face, a slidable face, and so on. Further, some embodiments may include multiple switches 110 in the button assembly such that one switch contact is actuated when then face is in a first position (or undergoes a first motion) and another switch contact is actuated when the switch is in a second position (or undergoes a second motion). It should be appreciated that other embodiments may include three or more switches 110.

In certain embodiments, the modular button component 100 also includes a bracket 140. The bracket 140 may be a single metal piece that extends past a proximal end and a distal end of the center portion 105. Although a metal bracket is specifically mentioned, it is contemplated that the bracket 140 may be made from various materials. Additionally, it is contemplated that the bracket 140 may be split into various sections and/or has a different width along a length of the bracket 140. As shown, the bracket 140 includes one or more openings though with a screw, bolt, fastener or other attachment or securing mechanism may be used to secure the modular button component 100 to a printed circuit board and/or a housing of a mobile computing device.

Figure 2A:
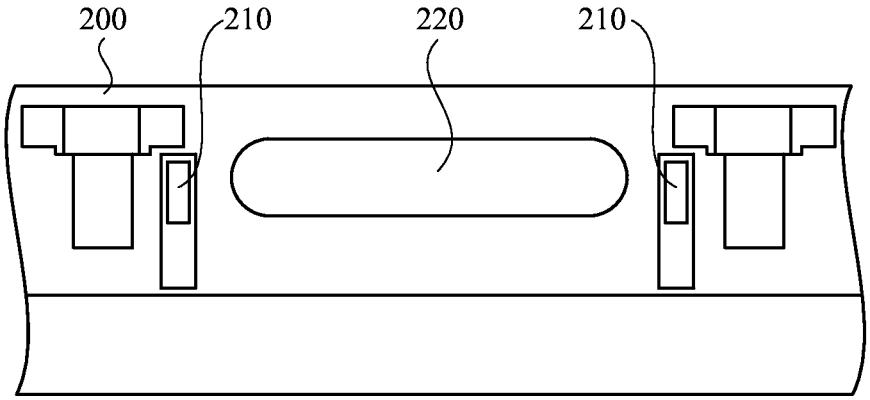
FIG. 2A illustrates a sample attachment structure to which the sample modular button component of FIG. 1 may be attached.

FIG. 2A illustrates an inner view of a housing 200 of a mobile computing device to which the modular button component 100 (FIG. 1) may be attached according to one or more embodiments of the present disclosure. As shown in FIG. 2A, a printed circuit board may be installed in a housing 200 of a mobile computing device. The printed circuit board may include one or more pads 210 to which the electrical contacts 130 (FIG. 1) of the modular button component 100 are to connect with. The housing 200 may also include an opening 220 through which a portion of a button assembly (such as the assembly 100 of FIG. 1) may be placed. For example, the outer wall 120 and center portion 105 of the button assembly 100 of FIG. 1 may pass through the opening 220 when the button assembly is affixed to the housing 200. In such an embodiment, the outer wall may be flush with the opposite side of the housing 200 or may extend outwardly from the opposite side of the housing 200.

Although the opening 220 is shown in an oval shape, it is contemplated that the opening may be any shape and/or size. It is also contemplated that the shape and size of the opening 220 may correspond to that of the raised outer wall 120 (FIG. 1) of the center portion 105 of the modular button component 100. Further, it should be appreciated that term "housing 200" is meant to encompass an external portion of an electronic device, a flex, a printed circuit board, an internal structure of an electronic device, and so on.

Figure 2B:
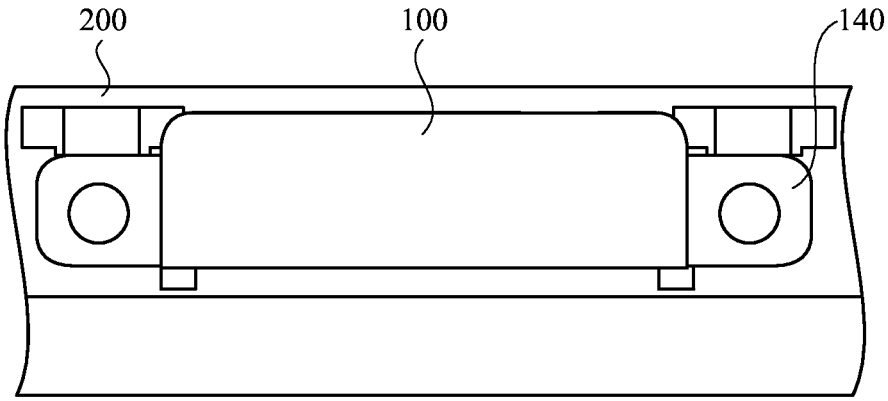
FIG. 2B illustrates the sample modular button component of FIG. 1 attached to the sample attachment structure of FIG. 2A.

FIG. 2B illustrates the modular button component 100 coupled to an inner portion of a housing and/or a flexible printed circuit board or a rigid printed circuit board of a mobile computing device according to one or more embodiments of the present disclosure. As described above, one or more brackets 140 may accept a screw or other fastener to removably couple the modular button component 100 to a printed circuit board and/or the housing of the mobile computing device. The fastener may secure the bracket to a support structure 225, as shown in FIG. 2B. The support structure 225 may deform inwardly under sufficient pressure from the fastener to ensure a tight seat and fit between the housing 200 and the button assembly 100, as well as to provide some tolerance for seating of the button assembly.

As also discussed above, the modular button component 100 may be configured to create a watertight seal between the tactile switch 110 (FIG. 1) and the printed circuit board. For example, a watertight adhesive may be used to join the button assembly 100 to the housing or to create a watertight seal. Alternately, the raised outer wall 120 may be sized to tightly abut the sides of the opening 220, thereby leaving no space for liquid ingress.

In embodiments, the design of the modular button component 100 enables the entire modular button component to be removed and replaced in a way not previously contemplated. For example, if the tactile switch is damaged, instead of replacing an entire flexible printed circuit board (which is costly), a technician or other user may simply remove and replace the modular button component 100. The disclosed design enables this simple replacement because the switch is not necessarily reflow soldered to the flexible printed circuit board as is typically done in previous designs.

Figure 3:
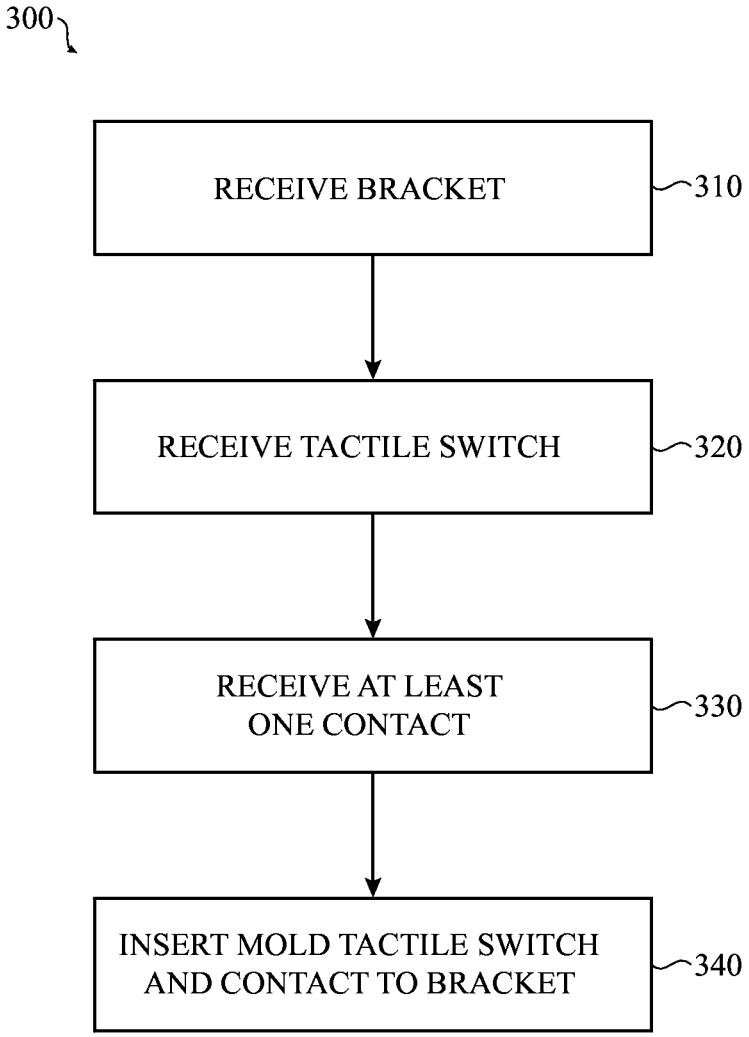
FIG. 3 illustrates a sample method of manufacturing a modular button component according to one or more embodiments of the present disclosure.

FIG. 3 illustrates a method 300 of manufacturing a modular button component according to one or more embodiments of the present disclosure. In certain embodiments, the method 300 described below may be used to manufacture the modular button component 100 of FIG. 1.

Method 300 begins when a bracket is received 310. In certain embodiments, the received bracket may be equivalent to bracket 140 (FIG. 1). Once the bracket is received, flow proceeds to operation 320 in which a tactile switch is received 320. In embodiments, the received tactile switch may be equivalent to tactile switch 110 described above with respect to FIG. 1. Flow then proceeds to operation 330 in which at least one electrical contact is received. As with the bracket and tactile switch discussed above, the electrical contact may be equivalent to electrical contact 130 described above. In certain embodiments, the electrical contact may be coupled to the tactile switch and/or one or more additional electrical contacts via one or more traces. Likewise, the switch and contacts may be positioned such that they are adjacent to, extend from, or are on the same side of the finished component as one another. In some embodiments, the switch and contact(s) may extend in the same direction from the modular component; this may be so even if the two are not on the same face/side.

Once all of the above components are received, flow proceeds to operation 340 in which the tactile switch, the contacts and associated traces are insert molded to the bracket. As discussed above, at the completion of this process, a modular button component is formed that may be removably coupled to a flexible printed circuit board.

Figure 4A:
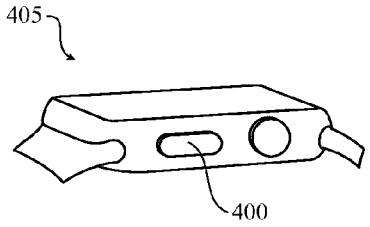
FIG. 4A illustrates one sample electronic device that may incorporate a modular button as described herein.
Figure 4B:
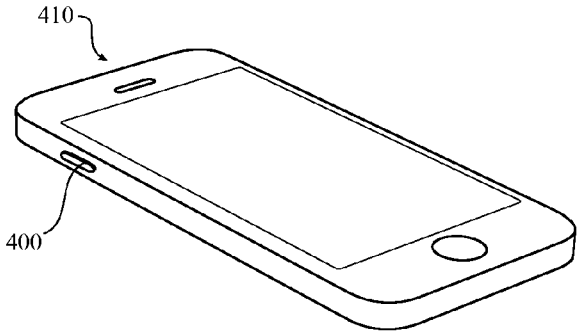
FIG. 4B illustrates a second sample electronic device that may incorporate a modular button as described herein.
Figure 4C:
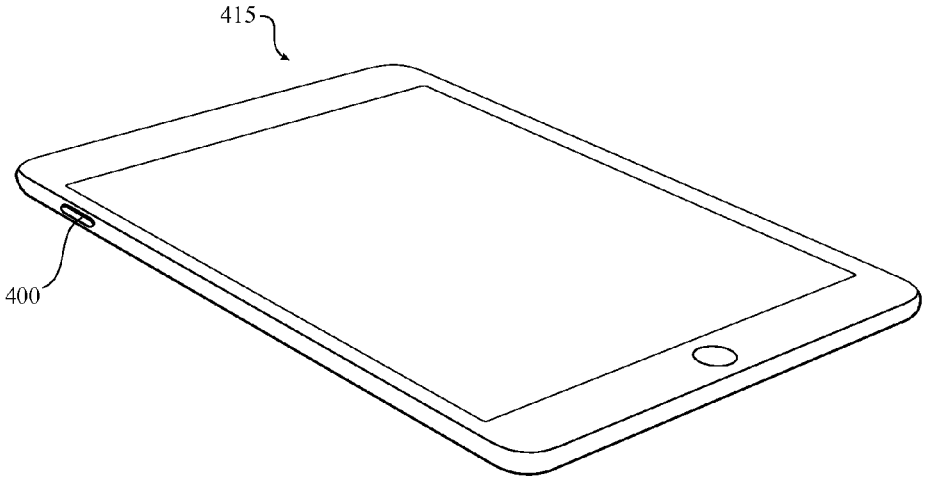
FIG. 4C illustrates a third sample electronic device that may incorporate a modular button as described herein.

FIGS. 4A-4C illustrate various sample electronic devices that may incorporate a modular button assembly as described herein. For example, a modular button 400 may be used in, and extend through, a housing of a wearable device 405 (as shown in FIG. 4A), a telephone 410 or other communications device (as shown in FIG. 4B), and/or a tablet computing device 415. Other wearable devices, such as glasses, jewelry and the like, may also incorporate a modular button as described herein, as may other electronic devices including, but not limited to, media players, computers, servers, touch pads, dashboards, and so on.

The description and illustration of one or more embodiments provided in this application are not intended to limit or restrict the scope of the present disclosure as claimed in any way. The embodiments, examples, and details provided in this application are considered sufficient to convey possession and enable others to make and use the best mode of the claimed embodiments. The claimed embodiments should not be construed as being limited to any embodiment, example, or detail provided in this application. Regardless of whether shown and described in combination or separately, the various features (both structural and methodological) are intended to be selectively included or omitted to produce an embodiment with a particular set of features. Having been provided with the description and illustration of the present application, one skilled in the art may envision variations, modifications, and alternate embodiments falling within the spirit of the broader aspects of the general inventive concept embodied in this application that do not depart from the broader scope of the claimed embodiments.

We claim:

1. A modular button component comprising:

a switch coupled to a center portion of the modular button component and extending from the center portion in a first direction;

a bracket extending beyond a length of the center portion of the modular button component; and at least one electrical contact positioned on the center portion and extending from the center portion in the first direction;

wherein the switch, the bracket and the at least one electrical contact are insert molded into a single assembly to form the modular button component that is configured to be removably coupled to a printed circuit board.

2. The modular button component of claim 1, wherein the at least one electrical contact is a spring finger.

3. The modular button component of claim 1, further comprising a raised portion that surrounds at least a part of the center portion of the modular button component and defines a recess; wherein the switch is contained within the recess.

4. The modular button component of claim 3, wherein the raised portion of the modular button component is configured to form a watertight seal between a housing of an electronic computing device and the modular button component.

5. The modular button component of claim 4, wherein:

the raised portion is configured to receive an adhesive;

the adhesive facilitates coupling the modular button component to a housing of an electronic computing device; and the adhesive facilitates the watertight seal.

6. The modular button component of claim 1, wherein the at least one electrical contact is configured to mate with at least one electrical pad coupled to the printed circuit board.

7. The modular button component of claim 1, wherein the bracket is configured to receive at least one securing mechanism operative to secure the modular button component to a circuit board.

8. The modular button component of claim 1, further comprising a dome operably associated with the tactile switch.

9. The modular button component of claim 1, wherein:

the switch is positioned on a first face of the center portion; and the at least one electrical contact is positioned on the first face of the center portion.

10. The modular button component of claim 9, further comprising a wall surrounding the switch; wherein the switch is positioned within a recess defined by the wall; and the at least one electrical contact is positioned outside the recess defined by the wall.

11. The modular button component of claim 10, further comprising a face extending at least partially into the recess, wherein the switch is operative to actuate in response to a motion of the face.

12. An electronic device comprising:

a structure defining an aperture;

a first electrical contact formed on a first side of the structure;

a button assembly comprising:

a body;

a wall extending from a first side of the body;

a switch encompassed by the wall on the first side of the body; and a second electrical contact on the first side of the body;

wherein the button assembly is attached to the structure so that:

the wall extends through the aperture; and the first and second electrical contacts physically touch one another.

13. The electronic device of claim 12, wherein the second electrical contact is a spring finger.

14. The electronic device of claim 12, further comprising a support structure to which the button assembly is attached by a fastener; wherein the support structure is operative to deform under a load exerted by the fastener.

15. The electronic device of claim 12, wherein the structure is one of a housing, a flex, or a circuit board.

* * * * *